US008783740B1

(12) United States Patent
Hurt

(10) Patent No.: US 8,783,740 B1
(45) Date of Patent: Jul. 22, 2014

(54) SECURITY LOCK FOR DOOR

(76) Inventor: Alfred A. Hurt, Oak Hill, WV (US)

( * ) Notice: Subject to any disclaimer, the term of this patent is extended or adjusted under 35 U.S.C. 154(b) by 718 days.

(21) Appl. No.: 12/470,486

(22) Filed: May 22, 2009

Related U.S. Application Data

(60) Provisional application No. 61/055,376, filed on May 22, 2008.

(51) Int. Cl.
*E05C 17/16* (2006.01)

(52) U.S. Cl.
USPC ..... 292/270

(58) Field of Classification Search
USPC ..... 292/340, 277
See application file for complete search history.

(56) References Cited

U.S. PATENT DOCUMENTS 267,035 A 11/1882 Streeter
771,588 A 10/1904 Taylor et al.
1,103,594 A * 7/1914 Lindsay ..... 292/262
2,461,398 A 2/1949 Sands
2,562,916 A 8/1951 Hoffman
2,593,312 A * 4/1952 Joseph ..... 217/60 D
3,411,817 A 11/1968 Carver
4,374,599 A * 2/1983 Hurt ..... 292/270
6,145,351 A * 11/2000 Levenson ..... 70/93
7,107,800 B2 * 9/2006 Chen ..... 70/93

* cited by examiner

*Primary Examiner* — Kristina Fulton
*Assistant Examiner* — Christine M Mills
(74) *Attorney, Agent, or Firm* — Johnston Holroyd; Mary-Jacq. Holroyd

(57) ABSTRACT

A security lock has first and second components with first base and extension flanges. The first extension flange extends perpendicular from the first base flange, and has a button extending from the first extension flange opposite the base. The second component has second base and extension flanges. The second extension flange extends hingedly from the second base flange, and has a longitudinal central slot extending therefrom for receiving the button. An apparatus for locking first and second extension flanges relative to one another and lock a door in at least two partially opened positions relative to a corresponding door jam.

17 Claims, 4 Drawing Sheets

Fig. 1
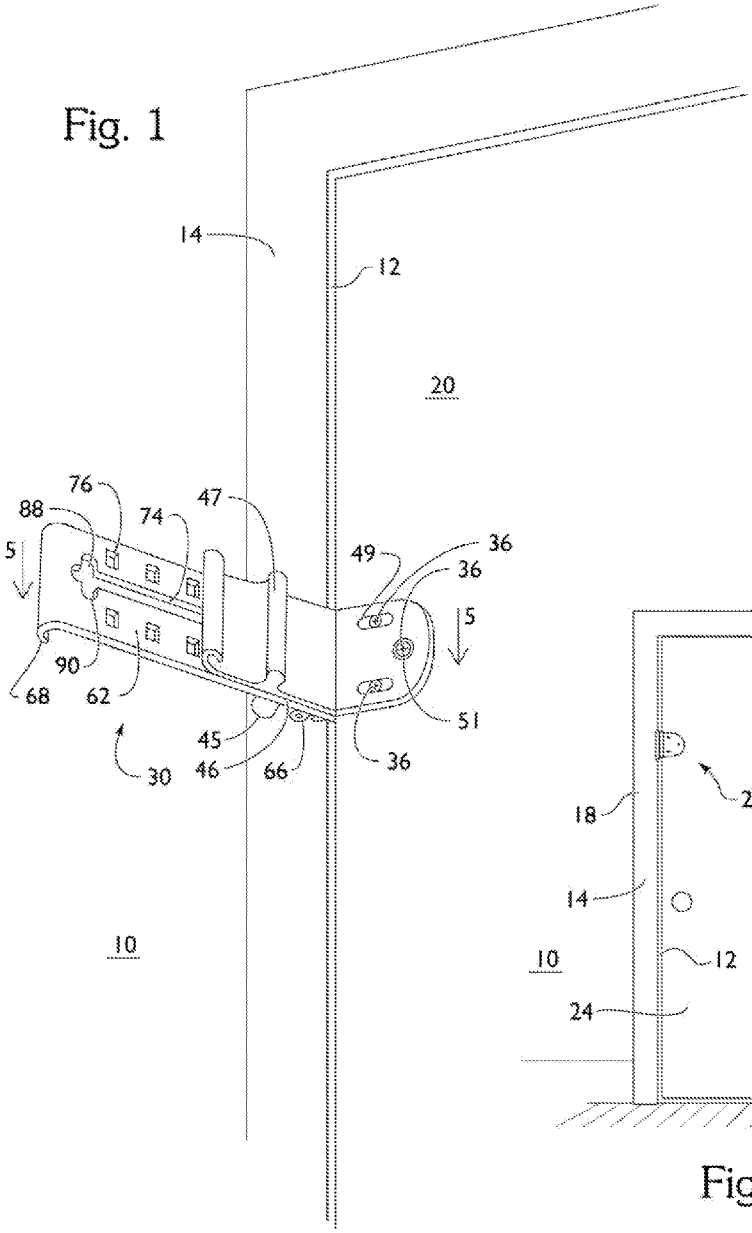
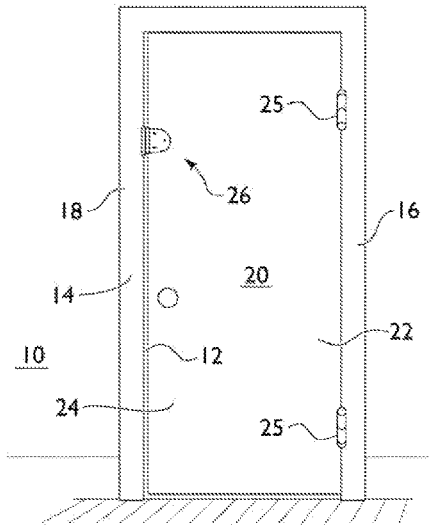
Fig. 2

SECURITY LOCK FOR DOOR

RELATED APPLICATIONS

This application claims the benefit of U.S. Provisional Application Ser. No. 61/055,376 entitled "SECURITY LOCK FOR DOOR" filed on 22 May 2008, the contents of which are incorporated herein by reference in its entirety.

BACKGROUND OF THE INVENTION

Various forms of door security lock structures have been provided. Some of these security lock structures include features which enable a door to be partially opened, but locked against unrestricted further opening to enable a person on the inside of a door to view the area outside of the door. However, many of these security locks utilize chains for accomplishing the locking function of the door in a partially opened position and chains allow an intruder to initially pull the door toward a closed position and then to forcibly move the door toward an open position with momentum of the intruder and the door being sufficient, in most cases, to break the door restraining chain. Accordingly, a need exists for an improved form of security lock for doors which will enable doors to be securely locked in a partially opened position not only against further movement toward the open position but also against movement toward the closed position.

Further, U.S. Pat. No. 4,374,599 shows a security lock for door that has a first stationary flange supported from the free swinging edge of a door, and a second pivoted flange mounted on the door jamb and opposing the stationary flange. U.S. Pat. No. 7,107,800 discloses a door bolt which is constructed to include a jam plate fixed to a door jamb and a doorplate assembly installed in the free end of adoor panel and adapted to secure the free end of the door panel to the jamb plate. Further examples of various forms of door security locks including some of the general structural and operational features of the instant invention are disclosed in U.S. Pat. Nos. 267,035, 771,588, 2,461,398, 2,562,916 and 3,411,817.

SUMMARY OF THE INVENTION

The security lock of the instant invention is constructed in a manner whereby an associated door may be locked in various partially opened positions against movement in either direction. The security lock includes structural features which enable the lock to be utilized in conjunction with substantially any form of swinging door and the lock is of such structure to enable ready operation thereof, even by inexperienced persons.

The main aspect of this invention is to provide a door security lock which will be capable of releasably locking a door in various partially opened positions.

Another aspect of this invention is to provide a security lock in accordance with the preceding aspect and including structure whereby the associated door will be locked in the adjusted position thereof not only against further opening but also against further closing.

Still another important aspect of this invention is to provide a security lock which may be readily utilized in conjunction with substantially any form of swinging door.

A further aspect of this invention is to provide a security lock which may be readily operated by even inexperienced persons.

Still another important aspect of this invention is to provide a security lock specifically adapted for secure mounting on related door and jamb components.

A final aspect of this invention to be specifically enumerated herein is to provide a door security lock in accordance with the preceding aspects and which will conform to conventional forms of manufacture, be of simple construction and easy to use as to provide a device that will be economically feasible, long lasting and relatively trouble free in operation.

These together with other aspects which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

FIG. 1 is a fragmentary perspective view of a door and jamb assembly with which the lock assembly of the instant invention is operatively associated;

FIG. 2 is an elevational view of the assemblage illustrated in FIG. 1 on somewhat of a reduced scale;

DETAILED DESCRIPTION OF PREFERRED EMBODIMENTS

Figure 3:
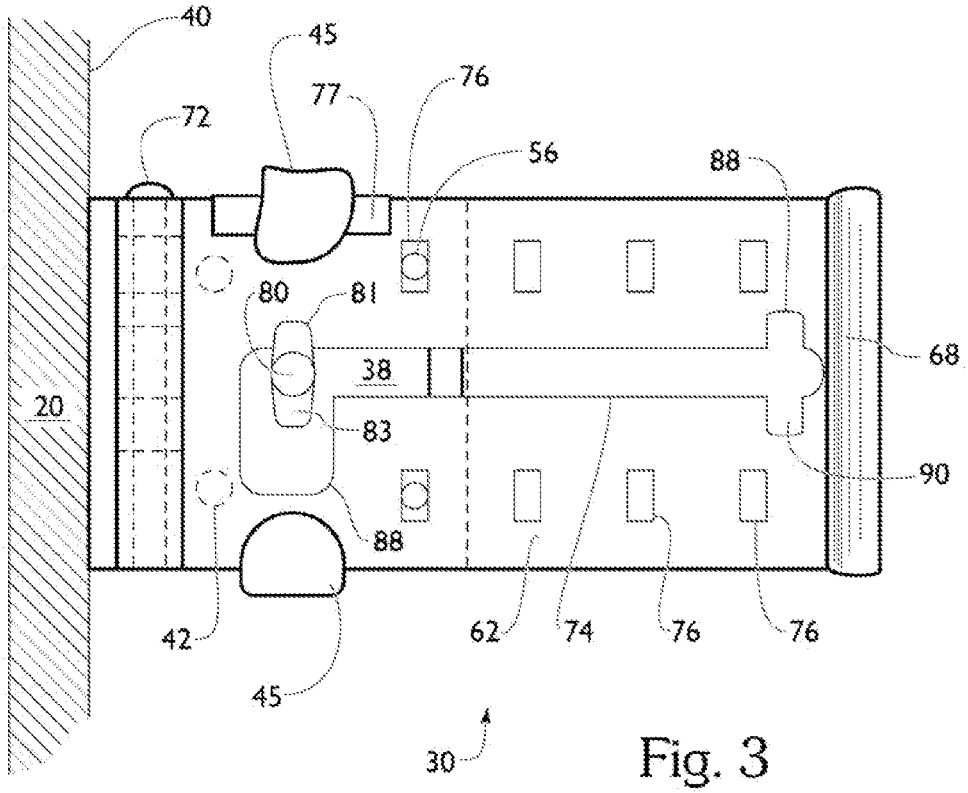
FIG. 3 is a side elevational view of the lock as seen from the left side of FIG. 1 and with the various components of the lock in a locked condition.

Referring now more specifically to the drawings the numeral 10 designates a wall structure having a door opening 12 defined therethrough by a door frame 14 including first and second marginal portions 16 and 18, as shown in FIG. 1. A door 20 is provided and includes first and second marginal portions 22 and 24 with the marginal portion 22 hingedly supported from the marginal portion 16 through the utilization of door hinges 25, as shown in FIG. 2.

Figure 4:
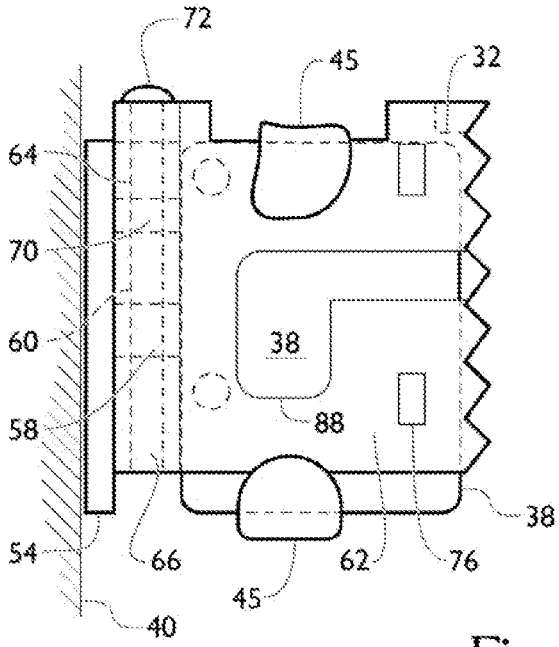
FIG. 4 is a fragmentary side elevational view similar to FIG. 3 but illustrating the pivoted flange portion of the lock in an upwardly displaced position enabling its swinging from an operative position toward a retracted position.

The security lock of the instant invention is referred to in general by the reference numeral 26 and includes first and second components 28 and 30. FIGS. 3 and 4 show a locked condition. The first component 28 includes a base flange 32, shown in FIGS. 5 and 6, secured to the inner side adjacent the edge 34 of the door 20 opposing the second marginal portion 18 through the utilization of fasteners 36 and an extension flange 38 formed perpendicularly with the base flange 32 and which projects outwardly of the side 40 of the door 20 which faces in the direction in which the door 20 opens. The base flange 32, also shown in FIG. 7, has two slits 49 to slidably accommodate fasteners 36 permitting proper placement of the first component 28 and an opening 51 for accommodating another fastener 36 to affix the position of the base flange 32 The extension flange 38 is provided with a pair of vertically spaced apertures 42 therein and a third larger aperture 44.

Figure 5:
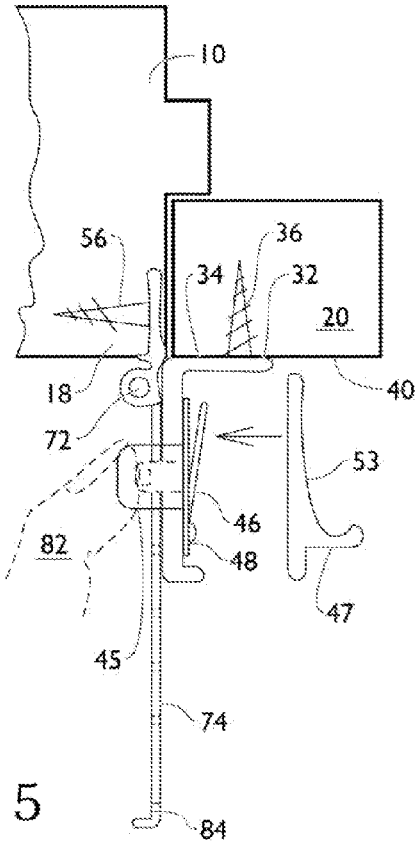
FIG. 5 is a horizontal sectional view taken substantially upon the plane indicated by the section line 5-5 of FIG. 1 and on somewhat of an enlarged scale.
Figure 6:
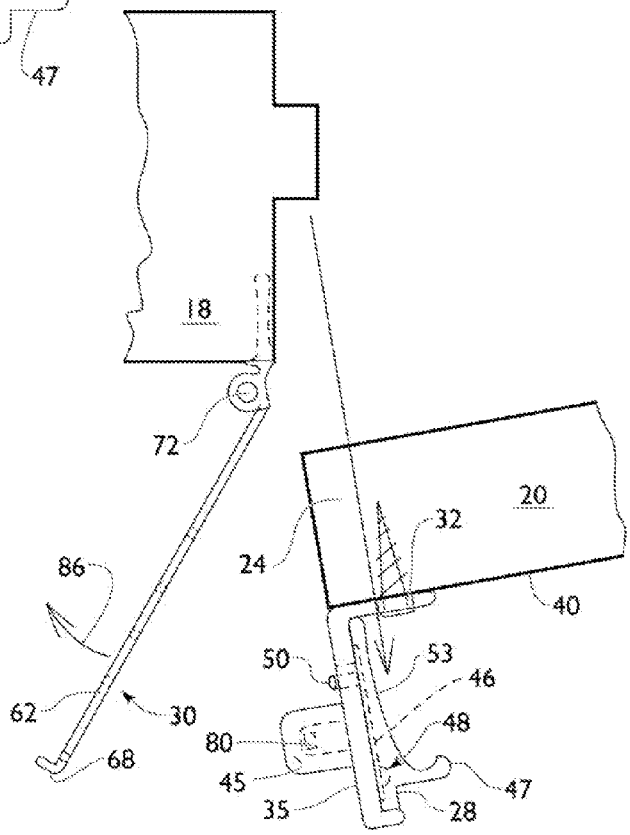
FIG. 6 is a top plan view of the lock assembly with the pivoted flange thereof partially swung toward a retracted position and the door being swung toward an open position.
Figure 7:
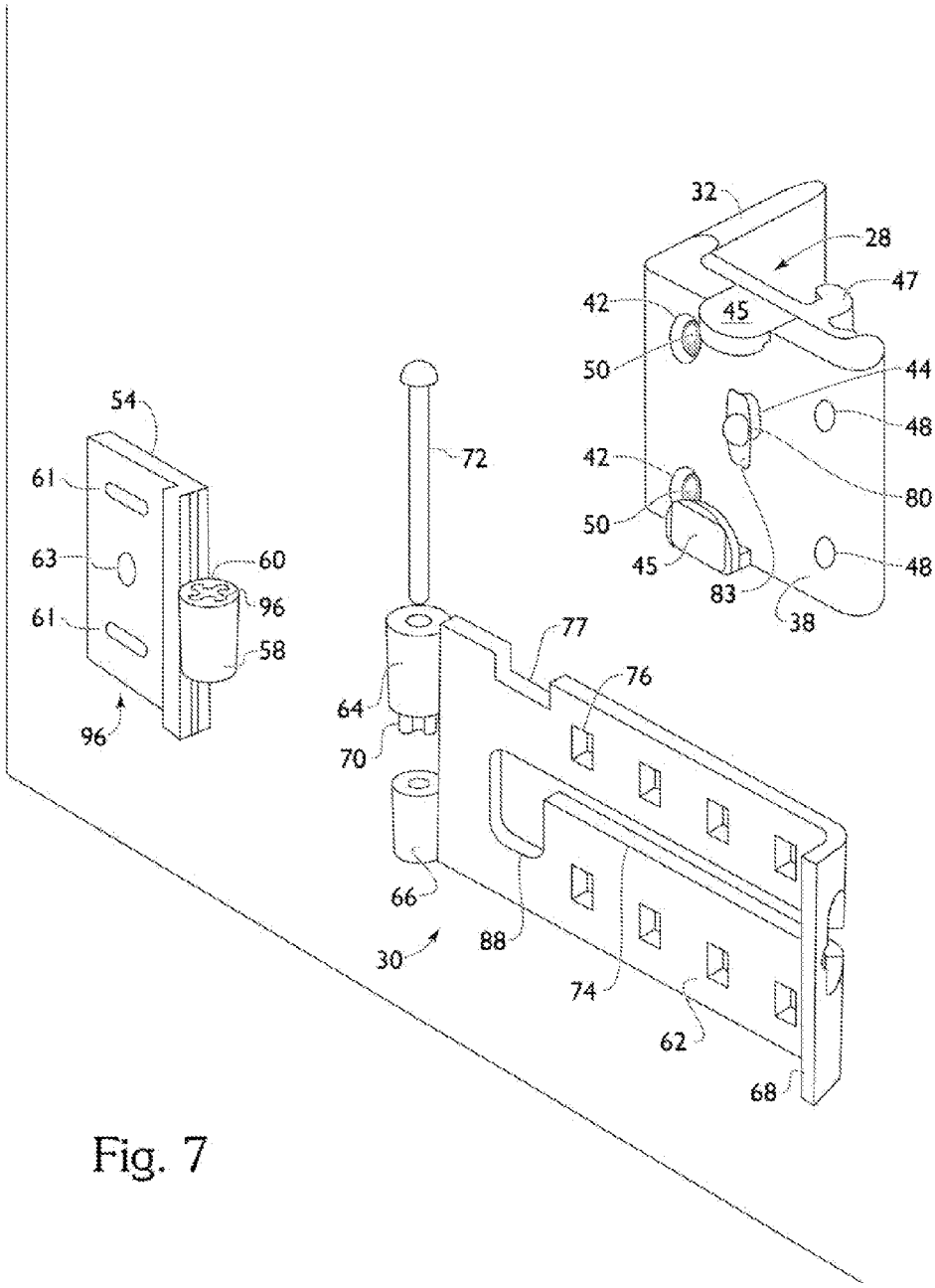
FIG. 7 is an exploded perspective view of the security lock. Similar reference characters denote corresponding features consistently throughout the attached drawings.

A spring plate 46, shown in FIGS. 5 and 6, is secured by rivets 48 to the outer end of the extension flange 38 on the side thereof remote from the second component 30 and extends toward the door 20. The end of the plate 46 remote from the fasteners or rivets 48 and adjacent the door 20 includes a pair of laterally projecting pins 50 which extend outwardly therefrom, through and beyond the apertures 42. Opposing holders 45 are disposed perpendicular and along the edges of the extension flange 38 for slidably accommodating the second component 30, as shown. A cover plate 53 with handle 47 is provided to cover the spring plate 46. The handle 47 permits controlled opening of the door 20.

The second component 30 includes a base flange 54 secured to the marginal portion 18 through the utilization of fasteners 56 and projecting slightly outwardly of the side of the marginal portion 18 toward which the door 20 swings when being opened. The outwardly projecting portion of the base flange 54 defines a single hinge barrel 58 including a diametric kerf 60 in its upper end. Two slits 61 are provided to slidably accommodate the fasteners 56 permitting proper placement of the base flange 54. An opening 63 is also provided to accommodate a fastener 36 and securely hold the base flange 54 in place once proper position is achieved.

The second component 30 additionally includes an extension flange 62 including a pair of vertically spaced hinge barrels 64 and 66 on one end between which the barrel 58 is receivable and a laterally outwardly turned portion 68 on its free end. The upper hinge barrel 64 of the extension flange 62 includes diametrically opposite lugs 70 downwardly receivable within the kerf 60, and upwardly retractable therefrom, a pivot pin 72 being passed through the barrels 64 and 66, and kerf 60 to pivotally support the extension flange 62 from the base flange 54. A guard is provided to enclose the lugs 70 and kerf 60 mechanisms.

A guide slot 77 is provided along the second component 30, as shown, to accommodate the upper opposing holder 45, while the second component 30 is upwardly retracted from the kerf 60. The extension flange 62 includes a longitudinal central slot 74 and longitudinally spaced pairs of upper and lower openings 76 formed therethrough above and below the slot 74 in which the outer ends of the pins 50 are selectively receivable.

In operation, when the door 20 is in the closed position thereof illustrated in FIG. 5 of the drawings and the lugs 70 are downwardly received in the kerf 60, the extension flange 62 is locked in the position thereof illustrated in FIG. 5 of the drawings against pivotal movement relative to the base flange 54. Further, when the spring plate 46 is in the solid line position, illustrated in FIG. 5, the pins 50 project through the apertures 52 and into the openings 76 closely adjacent the barrels 64 and 66 and thus lock the door 20 in the closed position thereof illustrated in FIG. 5.

When it is desired to swing the door toward a partially opened position, a button 80 supported from the spring plate 46 intermediate the pins 50 and the rivets 48 and projecting through the aperture 44 is pushed as indicated at 82 in FIG. 5 to cause flexure of the spring plate 46 and retraction of the pins 50 from the openings 76. Thereafter, the door 20 may be swung further toward an open position and locked in adjusted partially opened position by reception of the pins 50 through openings 76 spaced closer to the free end of the extension flange 62 upon release of finger pressure on the button 80. Additionally, when it is desired to open the door 20 to a fully opened position, the button 80 is depressed and the door 20 is swung toward the full open position with the free end of the button 80 received through the outer end 84 of the slot 74.

After the extension flange 38 of the first component 28 has been disengaged from the extension flange 62 of the second component 30, the extension flange 62 may be upwardly displaced relative to the base flange 54 in order to withdraw the lugs 70 from the kerf 60, thereby allowing the extension flange 62 to be swung in a clockwise direction in the manner illustrated by the arrow 86 in FIG. 6 of the drawings. In this manner, the extension flange 62 may be swung to a fully retracted position closely paralleling the wall 10. Also, the extension flange 62 includes an upwardly opening notch 88 formed therein opening upwardly into the lower marginal portion of slot 74. The notch 88 allows the button 80 to be depressed to retract the pins 50 and the flange 62 thereafter to be elevated to withdraw the lugs 70 from the kerf 60 and thereby allow the flange 62 to be swung in the direction of arrow 86 in FIG. 6 without first displacing the button 80 through the outer end of slot 74. Still further, the arcuate flange 62 has a radius of curvature substantially equal to the spacing of the flange 62 from the axis (not shown) of oscillation of the door 20.

Finally, the extended end of button 80 includes upwardly and downwardly projecting lugs 81 and 83 which, when the flange 62 and plate 46 are relatively positioned similar to those positions illustrated in FIG. 3 but with the door slightly open, prevent sufficient forced flexure between the flanges 38 and 62 to effect withdrawal of the pins 50 from the apertures 42 independent of flexure of the spring plate 46 relative to the flange 38. However, the outer end of the slot 74 includes enlargements 88 and 90 for receiving the lugs 81 and 83 therethrough.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is to be understood that the present invention is not limited to the embodiments described above, but encompasses any and all embodiments within the scope of the following claims.

What is claimed is:

1. A security lock, comprising:

first and second components, the first component configured to be affixed to a side of a door, the second component configured to be affixed to a door jam, such that first and second components mate to releasably lock the door in position relative to the door jam, wherein;

the first component has a first base flange, and a first extension flange, the first extension flange extending substantially perpendicular and projecting outwardly from the first base flange;

the first base flange having means for affixing to the side of the door such that the first extension flange rigidly extends substantially perpendicular and inwardly therefrom;

the first extension flange having a centrally disposed button, which button has a projecting portion, extending from the first extension flange opposite the first base flange;

the second component has a second base flange, and a second extension flange, the second extension flange extending hingedly from the second base flange;

the second base flange having means for affixing to a door jam such that the second extension flange can hingedly extend inwardly therefrom;

the second extension flange having a longitudinal central slot extending therefrom for receiving the button therethrough to slidably engage the first extension flange, the projecting portion of the button extending from the central slot to retain the button thereon;

a guide slot is provided in the second extension flange to receive an upper opposing holder disposed on the first extension flange in a closed position of the door;

a lower opposing holder is disposed on the first extension flange to slidably receive the bottom of the second extension flange thereon; and apparatus for locking the first and second extension flanges in place relative to one another thereby permitting a door to be locked in at least two partially opened positions relative to a corresponding door jam.

2. The security lock of claim 1, wherein:

the apparatus for locking the first and second extension flanges in place relative to one another comprises at least one laterally projecting pin extending from the first or second extension flange opposite the base;

at least one corresponding opening disposed in the opposite second or first extension flange to releasably retain the laterally projecting pin therein; and apparatus for releasably engaging each laterally projecting pin in a corresponding opening.

3. The security lock of claim 1, wherein:

either or both base flanges have two slots and an opening to accommodate fasteners therethrough.

4. The security lock of claim 1, wherein:

the second base flange and the second extension flange are hingedly attached by a hinge with a pivot pin, the hinge having a barrel engaging a kerf with matching lugs permitting the second extension flange to have first and second relative positions, while remaining retained on the pivot pin;

the longitudinal central slot has a notch to facilitate engaging the button thereon; or combinations thereof.

5. The security lock of claim 1, further comprising:

a handle disposed on the first extension flange opposite the button and extending from the same side of the first extension flange as the first base flange.

6. The security lock of claim 1, wherein:

a cover plate is disposed over the apparatus for releasably engaging the laterally protecting pins opposite the laterally projecting pins; and the apparatus for releasably engaging the laterally projecting pins comprises a spring plate affixed opposite the laterally projecting pins to releasably push the pins outwards.

7. A security lock, comprising:

first and second components, the first component configured to be affixed to a side of a door, the second component configured to be affixed to a door jam, such that first and second components mate to releasably lock the door in position relative to the door jam, wherein;

the first component has a first base flange, and a first extension flange, the first extension flange extending substantially perpendicular and projecting outwardly from the first base flange;

the first base flange having means for affixing to the side of the door such that the first extension flange rigidly extends substantially perpendicular and inwardly therefrom;

the first extension flange having a centrally disposed button, which button has a projecting portion, extending from the first extension flange opposite the first base flange;

the second component has a second base flange, and a second extension flange, the second extension flange extending hingedly from the second base flange;

the second base flange having means for affixing to a door jam such that the second extension flange can hingedly extend inwardly therefrom;

the second extension flange having a longitudinal central slot extending therefrom for receiving the button therethrough to slidably engage the first extension flange, the projecting portion of the button extending from the central slot to retain the button thereon;

the longitudinal central slot has a notch to facilitate engaging the button thereon;

a guide slot is provided in the second extension flange to receive an upper opposing holder disposed on the first extension flange in a closed position of the door;

a lower opposing holder is disposed on the first extension flange to slidably receive the bottom of the second extension flange thereon; and apparatus for locking the first and second extension flanges in place relative to one another thereby permitting a door to be locked in at least two partially opened positions relative to a corresponding door jam, wherein the apparatus for locking the first and second extension flanges in place relative to one another comprises at least one laterally projecting pin extending from the first or second extension flange opposite the base;

at least one corresponding opening disposed in the opposite second or first extension flange to releasably retain the laterally projecting pin therein; and apparatus for releasably engaging each laterally projecting pin in a corresponding opening.

8. The security lock of claim 7, wherein:

the second base flange and the second extension flange are hingedly attached by a hinge with a pivot pin, the hinge having a barrel engaging a kerf with matching lugs permitting the second extension flange to have first and second relative positions, while remaining retained on the pivot pin.

9. The security lock of claim 7, further comprising:

a handle disposed on the first extension flange opposite the button and extending from the same side of the first extension flange as the first base flange.

10. The security lock of claim 7, wherein:

a cover plate is disposed over the apparatus for releasably engaging the laterally protecting pins opposite the laterally projecting pins; and the apparatus for releasably engaging the laterally projecting pins comprises a spring plate affixed opposite the laterally projecting pins to releasably push the pins outwards.

11. The security lock of claim 7, wherein:

the positioning of either or both of the base flanges are adjustable.

12. The security lock of claim 11, wherein:

either or both base flanges have two slots and an opening to accommodate fasteners therethrough.

13. A security lock, comprising:

first and second components, the first component configured to be affixed to a side of a door, the second component configured to be affixed to a door jam, such that first and second components mate to releasably lock the door in position relative to the door jam, wherein;

the first component has a first base flange, and a first extension flange, the first extension flange extending substantially perpendicular and projecting outwardly from the first base flange;

the first base flange having means for affixing to the side of the door such that the first extension flange rigidly extends substantially perpendicular and inwardly therefrom;

the first extension flange having a centrally disposed button, which button has a projecting portion, extending from the first extension flange opposite the first base flange;

the second component has a second base flange, and a second extension flange, the second extension flange extending hingedly from the second base flange;

the second base flange having means for affixing to a door jam such that the second extension flange can hingedly extend inwardly therefrom;

the second extension flange having a longitudinal central slot extending therefrom for receiving the button therethrough to slidably engage the first extension flange, the projecting portion of the button extending from the central slot to retain the button thereon;

the longitudinal central slot has a notch to facilitate engaging the button thereon;

a guide slot is provided in the second extension flange to receive an upper opposing holder disposed on the first extension flange in a closed position of the door;

a lower opposing holder is disposed on the first extension flange to slidably receive the bottom of the second extension flange thereon;

apparatus for locking the first and second extension flanges in place relative to one another thereby permitting a door to be locked in at least two partially opened positions relative to a corresponding door jam, wherein the apparatus for locking the first and second extension flanges in place relative to one another comprises at least one laterally projecting pin extending from the first or second extension flange opposite the base;

at least one corresponding opening disposed in the opposite second or first extension flange to releasably retain the laterally projecting pin therein; and apparatus for releasably engaging each laterally projecting pin in a corresponding opening; and the second base flange and the second extension flange are hingedly attached by a hinge with a pivot pin, the hinge having a barrel engaging a kerf with matching lugs permitting the second extension flange to have first and second relative positions, while remaining retained on the pivot pin.

14. The security lock of claim 13, further comprising:

a handle disposed on the first extension flange opposite the button and extending from the same side of the first extension flange as the first base flange.

15. The security lock of claim 13, wherein:

a cover plate is disposed over the apparatus for releasably engaging the laterally protecting pins opposite the laterally projecting pins;

the apparatus for releasably engaging the laterally projecting pins comprises a spring plate affixed opposite the laterally projecting pins to releasably push the pins outwards; or combinations thereof.

16. The security lock of claim 13, wherein:

the positioning of either or both of the base flanges are adjustable.

17. The security lock of claim 16, wherein:

either or both base flanges have two slots and an opening to accommodate fasteners therethrough.

* * * * *